US005137010A

United States Patent [19]

Whitfield et al.

[11] Patent Number: 5,137,010

[45] Date of Patent: Aug. 11, 1992

[54] COMBUSTION GRATE FOR PELLET FUELED STOVE

[75] Inventors: Oliver J. Whitfield, Bow; Phillip W. Robertson, Mt. Vernon; Craig G. Wright, Bellingham, all of Wash.

[73] Assignee: Pyro Industries, Inc., Burlington, Wash.

[21] Appl. No.: 745,204

[22] Filed: Aug. 14, 1991

[51] Int. Cl.[5] ..... F23H 15/00

[52] U.S. Cl. ..... 126/173; 126/244; 110/285; 110/170

[58] Field of Search ..... 126/173, 167, 174, 242, 126/244, 245, 243; 110/278, 279, 285, 289, 290, 327, 114, 113, 265, 286, 101 A, 101 R, 170

[56] References Cited

U.S. PATENT DOCUMENTS

| | | | |
|---|---|---|---|
| 91,357 | 6/1869 | Mayer | 126/245 |
| 159,666 | 2/1875 | Goodfellow | 126/245 |
| 159,667 | 2/1875 | Goodfellow | 126/245 X |
| 402,002 | 10/1988 | Rathbowe | 126/242 |
| 876,670 | 1/1988 | Walker | 126/242 X |
| 1,648,976 | 11/1927 | Wagner . | |
| 1,860,442 | 5/1932 | Wares | 126/173 |
| 2,315,070 | 3/1943 | McNaughton | 126/99 |
| 2,367,590 | 1/1945 | Lewers et al. | 110/7 |
| 2,739,547 | 3/1956 | Triggs | 126/174 X |
| 4,007,697 | 2/1977 | Prill | 110/45 |
| 4,280,474 | 7/1981 | Ruegg, Sr. | 126/121 |
| 4,383,517 | 5/1983 | Gillis et al. | 126/61 |
| 4,426,937 | 1/1984 | Sietmann et al. | 110/288 |
| 4,430,948 | 2/1984 | Schafer et al. | 110/101 R |
| 4,449,462 | 5/1984 | Robb | 110/288 |
| 4,517,905 | 5/1985 | Chastain et al. | 110/346 |
| 4,548,194 | 10/1985 | Schafer et al. | 126/110 R |
| 4,565,184 | 1/1986 | Collins et al. | 126/368 |
| 4,947,769 | 8/1990 | Whitfield | 110/259 |

FOREIGN PATENT DOCUMENTS

| | | | |
|---|---|---|---|
| 668440 | 12/1938 | Fed. Rep. of Germany | 126/173 |
| 1076708 | 10/1954 | France . | |
| 59-157417 | 9/1984 | Japan . | |
| 28332 | 11/1913 | United Kingdom . | |

OTHER PUBLICATIONS

Pyro Industries, Inc., Advertising Brochure for Whitefield Pellet Stoves, copyright 1991.

*Primary Examiner*—Larry Jones

*Attorney, Agent, or Firm*—Christensen, O'Connor Johnson & Kindness

[57] ABSTRACT

Stoves fueled by biomass pellets are provided with a grate assembly that supports the pellets for combustion and directs combustion gas into the fire. The grate assembly includes a passive grate and a moveable elongate blade spaced above the upper surface of the grate to direct ash and clinkers through a plurality of elongate slots in the grate. The design of the planar plate and the movement of the blade serves to prevent the ash and clinkers from accumulating on the grate in amounts that could block the elongate slots and reduce the flow of combustion gas into the fire.

26 Claims, 4 Drawing Sheets

COMBUSTION GRATE FOR PELLET FUELED STOVE

FIELD OF THE INVENTION

The present invention relates to combustion grates for stoves that are fueled by pellets formed from biomass materials.

BACKGROUND OF THE INVENTION

Stoves for burning fuel in the form of pellets manufactured from biomass are known to provide acceptable alternative heat sources for conventional heating units such as gas, electric and oil furnaces. Such stoves generally include a sealable firebox into which is fed fuel and air or other gases to support the combustion of the fuel. Stoves for residential heating utilize either a top feed mechanism that delivers the pelletized fuel onto a grate or a bottom feed system that forces the pellets into a burn pot from below. The top feed system is generally considered to be preferable due to its simpler design. In a top feed system, in order to provide sufficient amounts of combustion gases to the fuel, the grate onto which the fuel is deposited includes a perforated plate wherein the combustion gases pass through the perforations into the burning fuel. The major drawback of the top feed system has been the inability to remove the non-combustible ash and clinkers and from the grate after combustion of the pellets. The accumulation of the ash and clinkers is troublesome because it eventually blocks the flow of air through the perforations in the grate and into the fire. This results in reduced heat output and burning efficiency.

Accordingly, there is a need for an improved grate and grate assembly which provides the advantages described above with regard to perforated grates, without suffering from the drawbacks associated with the accumulation of non-combustible ash and clinkers. A suitable grate and grate assembly would allow for the effective removal of non-combustible ash and clinkers from the grate to prevent clogging of the perforations in the grate.

SUMMARY OF THE INVENTION

The present invention provides a grate and a grate assembly for a stove fueled by biomass pellets that overcomes the problem of accumulation of ash and clinkers encountered by conventional grates. By preventing the accumulation of ash and clinkers which can block perforations in the grate, the flow of combustion gas into the fire is maintained at a level which allows the stove to burn the fuel efficiently and provide an efficient heat output. In addition to providing the advantages discussed above, the grate and grate assembly allows removal of the ash and clinkers from the grate to a location where they can be readily removed from the stove.

In one aspect, a grate assembly formed in accordance with the present invention includes a planar plate that serves to support biomass pellets above an ash pan in the stove. The planar plate includes at least one elongate slot that passes through the planar plate. Extending parallel to the elongate slot over the planar plate is an elongate blade that includes a first end and second end opposite the first end. A first skid and a second skid are attached to the elongate blade. The first skid and second skid rest on the upper surface of the planar plate to position the elongate blade in a plane spaced above the planar plate. The elongate blade is attached to an arm, movement of the arm causes the blade to move in a direction substantially transverse to the elongate slot.

In operation, the elongate blade moves back and forth across the grate in a direction substantially transverse to the elongate slot. Movement of the elongate blade pushes non-combustible ash into the slot where it drops through the planar plate and into the ash pan below. Movement of the elongate blade also helps to break up clinkers as they are forming and push them into the elongate slot. In this manner, the grate assembly formed in accordance with the present invention serves to minimize or prevent the accumulation of ash and clinkers on the upper surface of the planar plate. If not removed, the accumulated ash and clinkers can block the slot through which combustion gases normally flow to fuel the fire. A reduction of the flow of combustion gas into the fire is undesirable because it reduces the efficiency of combustion and heat output of the stove.

In another aspect, the present invention is a passive grate that includes a planar plate having at least one elongate slot that passes through the planar plate. At least one end of the elongate slot substantially abuts an end of the planar plate. The plate is used for stoves that are fueled by biomass pellets. In preferred embodiments of this aspect of the present invention, the grate includes a plurality of slots having ends that substantially abut the transverse ends of the planar plate. The slots are dimensioned to allow fuel to be supported on the plate and ash to fall through the plate, while at the same time providing a velocity of combustion air through the slots which is insufficient to result in substantial dispersion of the ash.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF THE PREFERRED EMBODIMENT

A grate assembly formed in accordance with the present invention is designed for use in a stove fueled by biomass pellets. Biomass pellets are typically made from materials such as wood waste, agricultural residue, paper, coal dust, garbage, and the like. These types of pellets are generally preformed in the shape of small cylinders, although other shapes of preformed fuel can be burned in accordance with the present invention. The advantages of using a grate assembly and passive grate formed in accordance with the present invention are particularly evident when used in combination with biomass pellets that contain more than about one percent ash. Combustion of pellets having an ash content greater than about one percent produces a volume of ash and clinkers that if not removed by the grate assembly of the present invention will eventually cause blockage of the combustion air holes in the grate.

Figure 1:
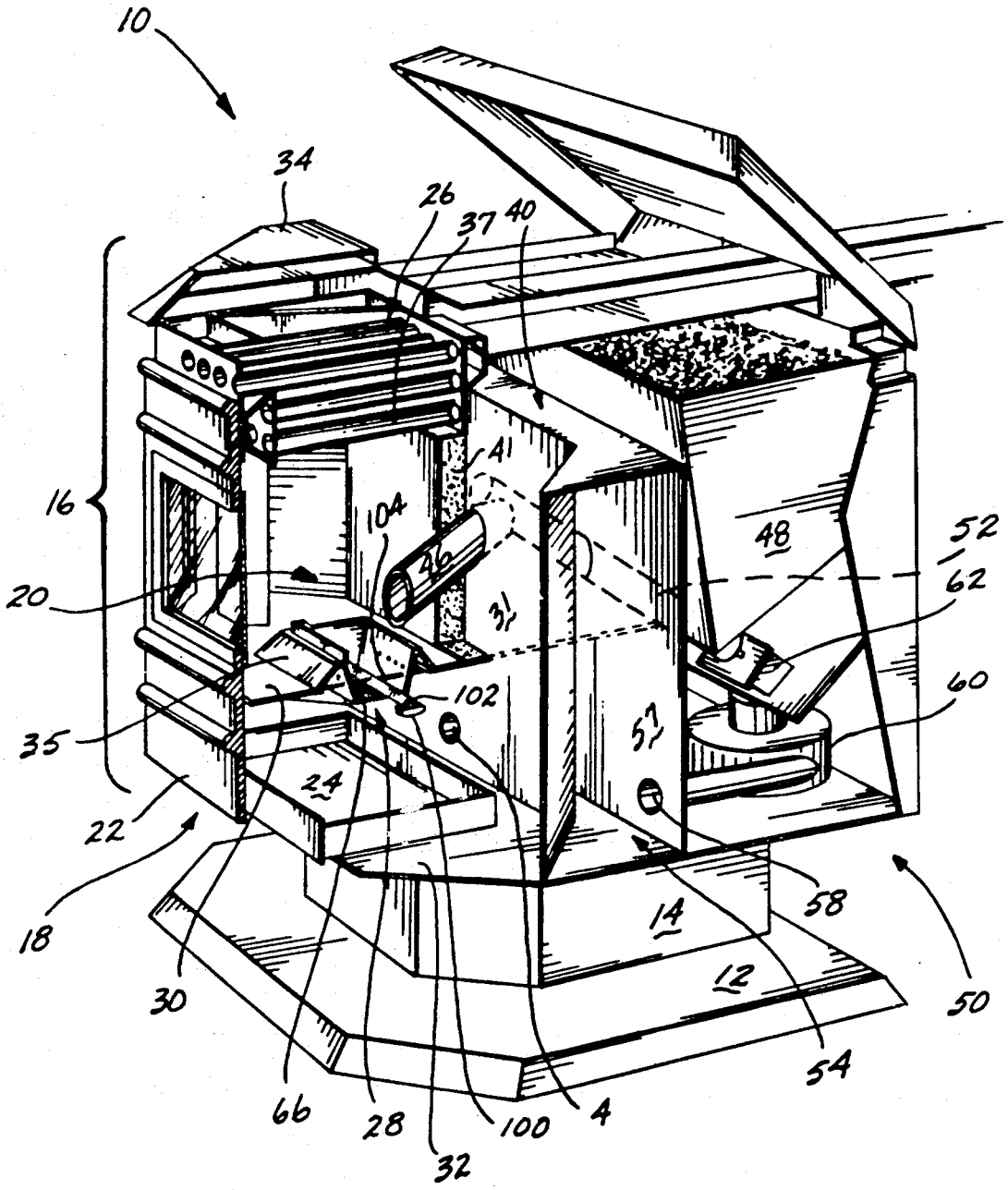
FIG. 1 is a perspective view of a stove fueled by biomass pellets with a portion cut away including a grate assembly, including a passive grate formed in accordance with the present invention.

Referring to FIG. 1, stove 10 is fueled by biomass pellets and includes a flat rectangular base 12. Centered on top of base 12 is a generally rectangular pedestal 14. Resting on top of rectangular pedestal 14 spaced above base 12 is body 16 of stove 10. Stove body 16 is generally cubical in shape and includes a front section 18 that includes firebox 20, door 22, ash pan 24, heat exchange unit 26, grate assembly 28, and platform 30.

Firebox 20 is an upright chamber having a cross-section in a horizontal plane generally in the shape of a hexagon. The forward-most three-sides of firebox 20 are defined by door 22 that includes three window-panels in the configuration of a bay window. The side of firebox 20 opposite door 22 is defined by firewall 31. The left and right sides of door 22 and firebox 31 are connected by the remaining two sides of firebox 20. Firebox 20 is closed in at its bottom by floor 32 and at its top by lid 34.

Heat exchange unit 26 is positioned at the top of front section 18 within firebox 20. Heat exchange unit 26 includes a shell and tube type of heat exchanger. The shell side of heat exchanger 26 carries hot gases from the combustion of fuel within firebox 20. The tube side of heat exchanger 26 carries air to be heated and dispensed from the stove. Spaced below heat exchange unit 26 about two-thirds of the way down firebox 20 is horizontal platform 30 that forms a false floor within firebox 20. Platform 30 is supported by firewall 31 and the sides of firebox 20 extending between firewall 31 and door 22. In order to allow door 22 to open, platform 30 abuts door 22 and seals against door 22 when it is in a closed position, but is not attached thereto. The center of platform 30 is cut away to provide an opening through to the bottom of firebox 20. As described below in more detail, the remaining portion of platform 30 defines a shelf that runs around the periphery of firebox 20 and is sealed against the walls of firebox 20 and serves to support bulkhead 35 which suspends grate assembly 28 above floor 32.

Ash pan 24 is located on floor 32 directly beneath the opening in platform 30. In this position, ash pan 24 collects ash and clinkers that are displaced from grate assembly 28 in accordance with the present invention. Preferably, ash pan 24 can be removed from firebox 20 so that cleaning of firebox 20 is simplified.

Firebox 20 shares firewall 31 as a common wall with middle section 40. Firewall 31 extends between the lower-most set of tubs 37 in heat exchange unit 26 and floor 32 and isolates elements behind it from the heat of firebox 20. A portion of firewall 31 from a point below heat exchange unit 26 to platform 30 includes a layer 41 of heat insulating material further isolating elements behind layer 41 and firewall 31 from the heat of firebox 20. Heat insulating layer 41 should be selected from low cost materials with good insulating properties.

Below insulating layer 41, and platform 30, a passage 42 passes through firewall 31. Passage 42 allows primary combustion air in middle section 40 or from outside the stove to pass through firewall 31 into front section 18 and ultimately into the grate assembly 28 as described below in more detail.

Passing at about a 45 degree angle downward through firewall 31 and heat insulating layer 41 toward the front of stove 10 is fuel feed conduit 46. Fuel feed conduit 46 terminates above grate assembly 28 and delivers pelletized fuel to grate assembly 28 as described below.

To the rear of firewall 31 is middle section 40. Middle section 40 is a chamber 54 extending the full width of stove body 16 and extending upward from floor 32 to above the lower-most set of tubes 37. Middle section 40 shares a common wall 57 with rear section 50 which is described below n more detail. Wall 57 is spaced rearwardly from firewall 31. The top of wall 57 is connected to the top of firewall 31 by a metal plate. The sides of wall 57 are connected to the sides of firewall 31 by the sides of stove body 16. Accordingly, chamber 54 is defined between front section 18 and middle section 50. Chamber 54 acts as a plenum for air to be provided to fuel the fire and to carry heat into the surrounding room. Chamber 54 receives combustion air through opening 58 located near the bottom of wall 57. Opening 58 is connected to blower 60 that can pressurize chamber 54, causing air to flow through passage 42 into firewall 20. The volume of air in chamber 54 that does not enter firewall 20 through passage 42 moves upward and enters the lower-most set of tubes 37 and passes through heat exchange unit 26 where it is heated and eventually introduced into the surrounding room. Although the present invention is described in the context of a stove that includes a single blower for combustion and convection air, stoves having other arrangements for providing combustion air and convection air will benefit from the present invention.

Fuel feed conduit 46 also passes through middle section 40, including wall 57, where it enters into rear section 50. Rear section 50 comprises the balance of stove 10 to the rear of middle section 40. Rear section 50 is a generally upright rectangular box encasing fuel bin 48, auger 52, auger motor 62, and blower 60.

Blower 60 is located in the bottom of rearward most section 50. Spaced above blower 60 is auger 52 and auger motor 62. Positioned directly above auger motor 62 and occupying the upper half of rear section 50 is fuel bin 48. Auger motor 62 delivers pelletized fuel from the bottom of fuel bin 48 to feed conduit 46 via auger 52. Auger 52 angles upward from the bottom of fuel bin 48, toward the front of stove 10. Auger 52 and fuel feed conduit 46 meet at a poin . ust rearward of wall 57 where fuel in auger 52 is dumped into the top of fuel feed conduit 46. As described below in more detail, auger motor 62 also energizes the grate assembly 28 formed in accordance with the present invention.

In operation, fuel pellets are delivered from fuel bin 64 through auger 52 and fuel conduit 46 onto grate assembly 28. Blower 60 pressurizes chamber 54 slightly, causing combustion air to pass through passage 42 into firebox 20. Combustion of the pelletized fuel produces heat that is transferred via heat exchange unit 26 to the air that is passing through the tube side heat exchange unit 26. The heated air eventually passes into the open room. As the fuel is combusted, non-combustible ash and clinkers being to form on grate assembly 28. As described below in more detail, grate assembly 28, including the passive grate formed in accordance with the present invention is designed to remove the ash and clinkers from the grate.

Figure 2:
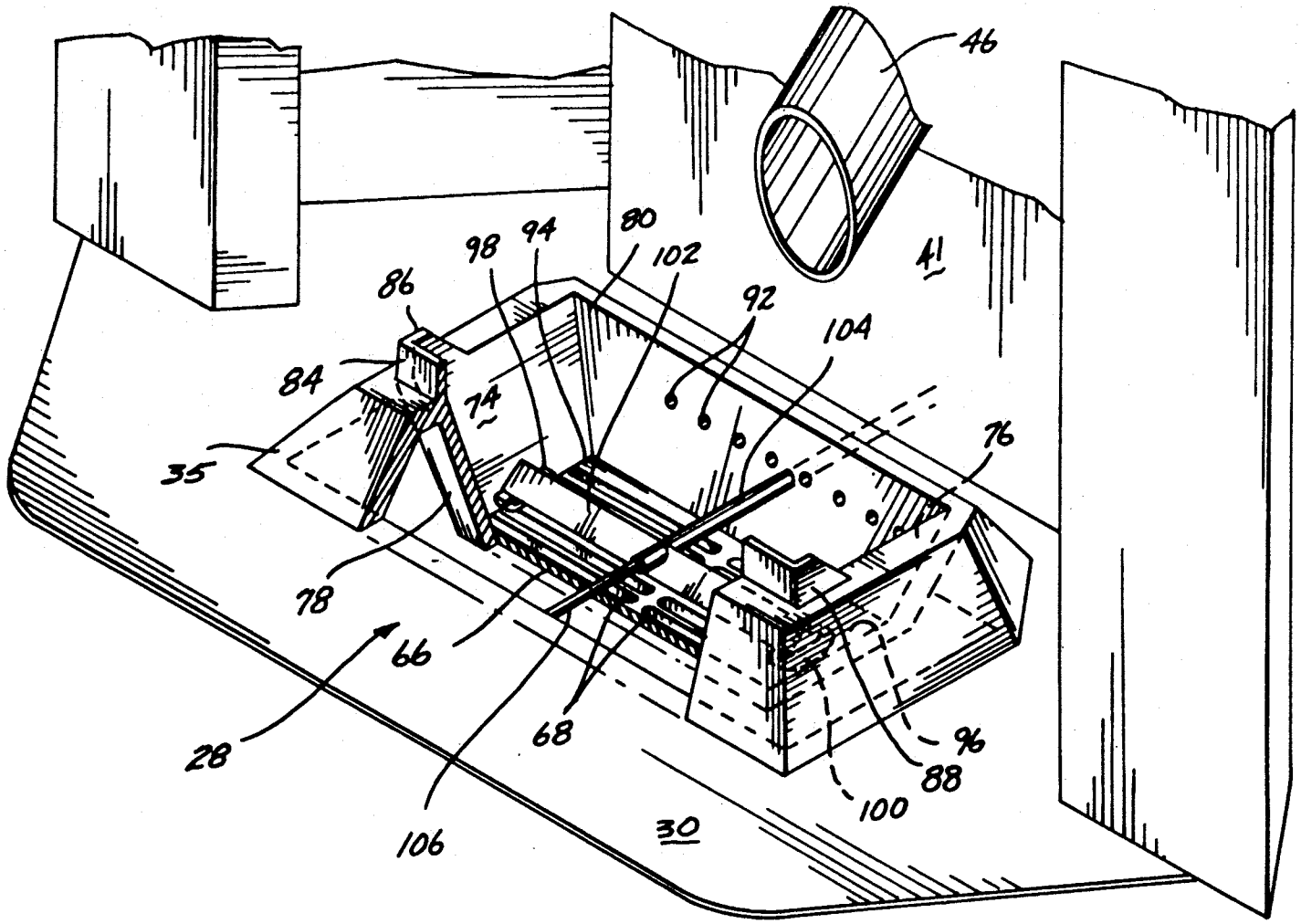
FIG. 2 is an enlarged perspective view of the grate assembly of FIG. 1 with a portion cut away.
Figure 3:
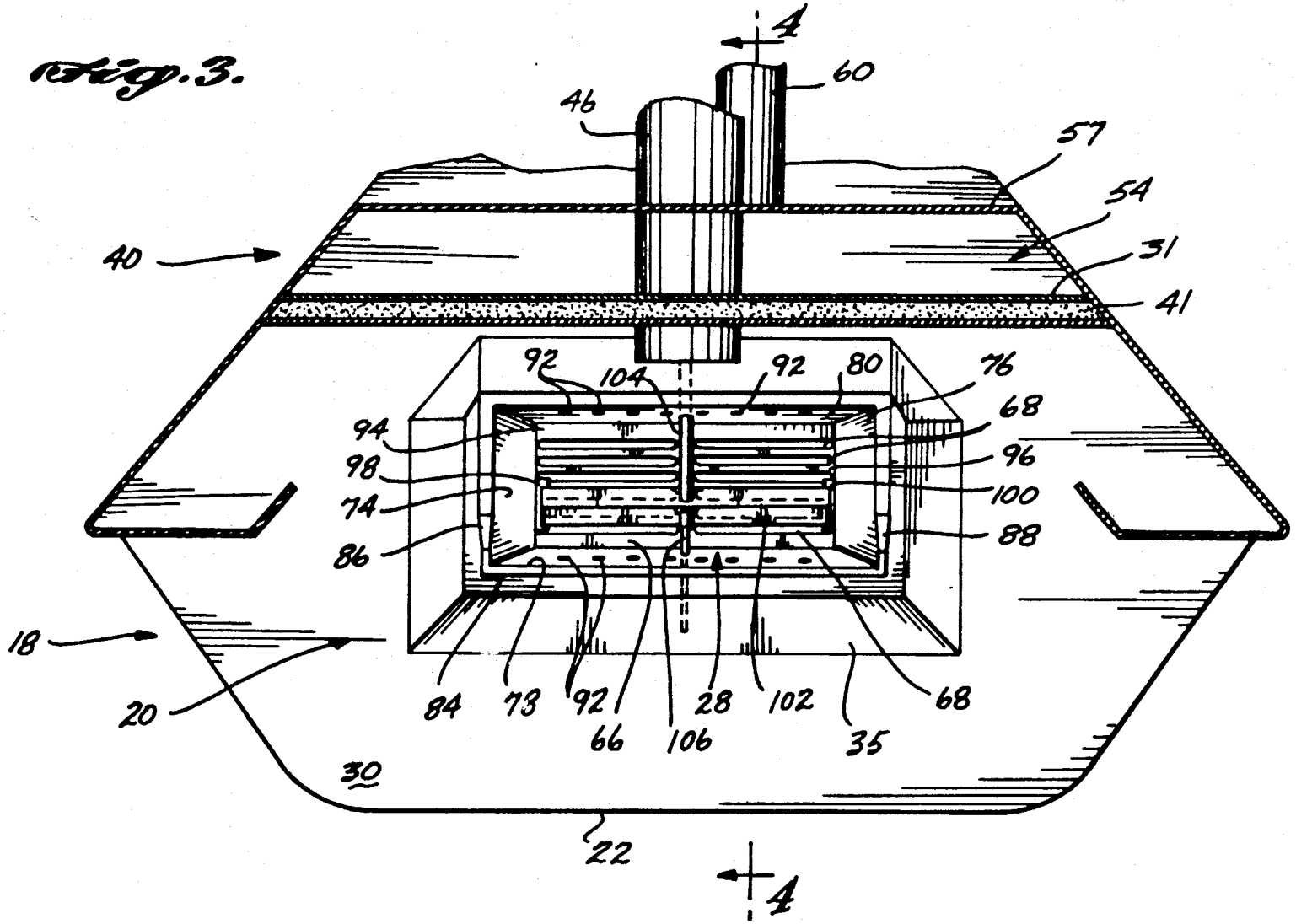
FIG. 3 is a top view of the grate assembly of FIG. 1.
Figure 4:
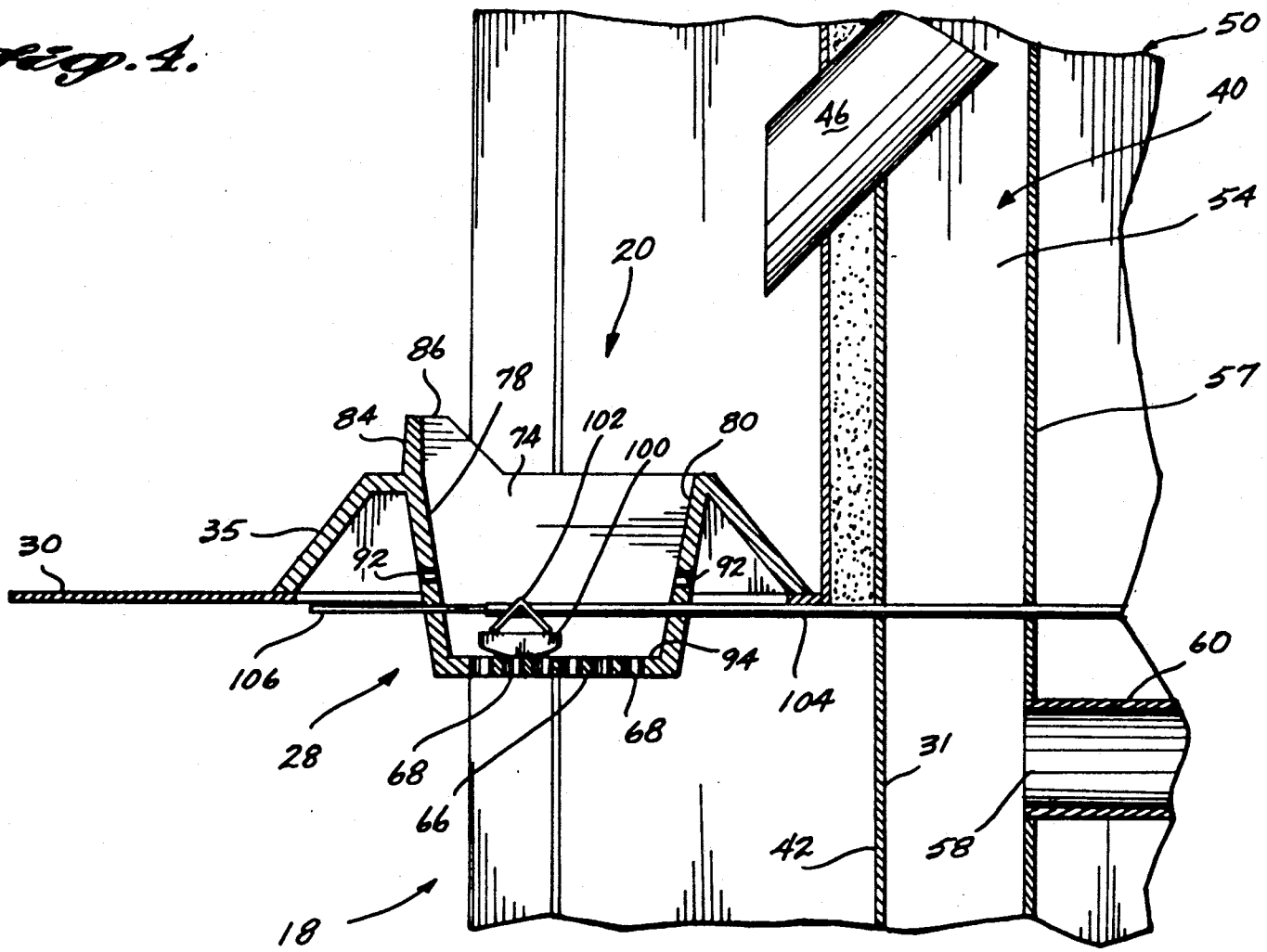
FIG. 4 is an elevation view of a cross section of the grate assembly of FIGS. 2 and 3 taken along line 4—4 in FIG. 3.

Referring to FIGS. 2, 3 and 4 which illustrate in more detail grate assembly 28 formed in accordance with the present invention, grate assembly 28 includes planar plate 66 which acts as a passive grate. Planar plate 66 is a flat, rectangular member made from conventional materials such as steel or iron. In the illustrated embodiment, a plurality of elongate slots 68 extend through planar plate 66. The length of slots 68 is substantially parallel to the length of planar plate 66. In the illustrated embodiment, slots 68 comprise a left and right set of slots. Although two sets of slots are preferred, other arrangements such as a single slot, more sets of slots or even a single set of slots are within the scope of the present invention. The set of slots 68 on the left-hand side of planar plate 66 extend from the left end 94 of planar plate 66 to about the center of planar plate 66. The set of slots 68 on the right-hand side of planar plate 66 extend from about the center to the right end 96 of planar plate 66. In this manner, slots 68 substantially abut the left end the planar plate 66 and the right end of planar plate 66. The width of slots 68 is less than the smallest diameter of the biomass pellets to be burned in stove 10. This prevents the pellets from falling through slots 68 into ash pan 24 before they are combusted. In the illustrated embodiment, elongate slots 68 have a width of about 0.15 to 0.25 inches. Slots of these dimensions are compatible with pellets having a diameter of about ¼ of an inch. Applicants have found that slots having a width falling within the ranges recited above provide the desired combination of support for the pelletized fuel and surface area through which combustion air may pass into the fire at a velocity that is insufficient to cause substantial dispersion of the ash. Furthermore, slots of this size provide a sufficiently sized gap through which ash may readily fall through the planar plate. As a guideline, the preferred number of slots 68 and their size should provide an open area through planar plate 66 of approximately 50–70 percent of the overall surface area of planar plate 66 without slots 68. Depending on the ash content of the fuel, use of planar plate as a passive grate will be sufficient to prevent undesirable accumulation of ash. Where the ash content is higher and the passive grate is unable to prevent undesirable accumulation of ash, the passive grate can be combined with a moveable arm as described below.

Grate assembly 28 further includes left wall 74 and right wall 76. Left and right walls 74 and 76 extend upward and slightly outward from left end 94 and right end 96 of planar plate 66. Extending upward and slightly outward from the front edge and rear edge of planar plate 66 are front wall 78 and rear wall 80. The rear ends of left wall 74 and right wall 76 are connected by rear wall 80. In a similar fashion, the fronts ends of left wall 74 and right wall 76 are connected by front wall 78. In this manner, the combination of the four walls serves to define a pot or cavity into which pelletized fuel is deposited and contained for combustion.

Planar plate 66 and walls 74, 76, 78, and 80 are suspended through the opening in platform 30. In the illustrated embodiment, suspension of planar plate 66 is accomplished by providing bulkhead 35 on top of platform 30 to which walls 74, 76, 78, and 80 are attached. Bulkhead 35 has a footprint that rests on platform 30 around the opening there through. Bulkhead 35 includes a left, right, front and rear wall that extend up from the footprint and have their upper edges connected to the top of left wall 74, right wall 76, front wall 78, and rear wall 80 respectively. The height of bulkhead 35 is less than the distance between planar plate 66 and the top of left wall 74, right wall 76, front wall 78 and rear wall 80. Accordingly, planar plate 66 is suspended below platform 30, with left wall 74, right wall 76, front wall 78 and rear wall 80 spaced apart from the edges of the opening in platform 30. As described below in more detail, the opening allows secondary combustion air to pass into the fire through front wall 78 and rear wall 80 above planar plate 66.

Front wall 78 above the surface where it is connected to bulkhead 35 includes a vertical extension 84 for deflecting errant fuel pellets from fuel feed conduit 46 on to planar plate 66. The forward most ends of left wall 74 and right wall 76 above the surface where they are connected to bulkhead 35 also include vertical extensions 86 and 88 for deflecting errant pellets onto planar plate 66.

Front wall 78 and rear wall 80 include a plurality of secondary airholes 92. Airholes 92 are located above platform 30 about half-way up front wall 78 and rear wall 80. Airholes 92 provide a passage for air to enter the fire above planar plate 66.

Grate assembly 28 further includes an elongate blade 102 that extends transversely between walls 74 and 76 in a direction parallel to elongate slots 68. Elongate blade 102, although shown as having a cross section in the shape of a triangle, may also have a cross section in the shape of a circle or square. Elongate blade 102 is elevated above planar plate 66 by left skid 98 and right skid 100 that are attached to the underside of the ends of elongate blade 102. While skids 98 and 100 are described as being attached to the ends of elongate blade 102, they can be located at other positions along the length of elongate blade 102. Skids 98 and 100 rest on the upper surface of planar plate 66 and elevate elongate blade 102 above planar plate 66, a distance sufficient to prevent crushing of the pellets that are positioned under elongate blade 102. Skids 98 and 100 are about as wide as the underside of elongate blade 102. The forward and rearward ends of skids 98 and 100 are rounded which allows the skids to ride smoothly over elongate slots 68.

The center of elongate blade 102 is attached to movable arm 104 that is coupled to auger motor 62 by a mechanism, such as a spring and cable actuator arm. Activation of the spring and cable actuator arm by auger motor 62 causes movable arm 104 to move in a direction substantially transverse to the length of elongate slots 68. Movable arm 104 is a tubular member that passes over stationary rod 106 in a telescoping arrangement. Stationary rod 106 extends across the opening in platform 30 and through front wall 78 with its forwardmost end affixed to the underside of platform 30. Stationary rod 106 extends rearward far enough so that reciprocation of moveable arm 104 does not result in moveable arm 104 coming off stationary rod 106. Moveable arm 104 is coupled to auger motor 62, accordingly, it passes rearward through rear wall 80, fire wall 34 and wall 57 of chamber 54 into the rear section 50 of stove body 16. Movement of elongate blade 102 serves to direct accumulated ash into slots 68 where it falls into ash pan 24. Movement of elongate blade 102 also serves to break up clinkers into smaller pieces which can also fall through slots 68 into ash pan 24.

In operation, fuel pellets are introduced onto planar plate 66 from fuel feed conduit 46. The angle of fuel feed conduit 46 is such that the pellets will fall directly into to box provided above and around planar plate 66. For those errant pellets whose momentum tends to carry them outside of the box, vertical extensions 84, 86, and 88 serve to deflect the pellets onto planar plate 66. Combustion air is provided to the fire through slots 68 and secondary airholes 92. As combustion of the fuel progresses and ash is produced, it begins to fall through slots 68. If necessary, movable arm 104 can be provided and reciprocated causing elongate blade 102 to direct additional ash through slots 68 into ash pan 24. In addition, elongate blade 102 breaks up any clinkers that may have formed and pushes them into slots 68. Since movable arm 104 is coupled to auger motor 62, its movement can be synchronized with the introduction of additional fuel onto planar plate 66. In this manner, the energy of the falling fuel and the movement of elongate blade 102 can be combined to direct the ash into the slots as well as break up clinkers that may be forming.

The passive grate and great assembly of the present invention prevents the slots from becoming clogged, which can reduce the amount of air that is provided to the fire. By minimizing clogging of the lots, the efficiency of the combustion and heat output is not compromised.

While the preferred embodiment of the invention has been illustrated and described, it will be appreciated that various changes can be made therein without departing from the spirit and scope and the invention.

The embodiments of the invention in which an exclusive property or privilege is claimed are defined as follows:

1. A grate assembly for use in a stove fueled by biomass pellets, the grate assembly comprising:

a planar plate including an upper surface and a lower surface opposite the upper surface, at least one elongate slot passing through the plate from the upper surface to the lower surface;

an elongate blade having a first end and a second end opposite the first end and extending substantially parallel to the elongate slot;

a first skid and a second skid attached to the elongate blade and resting on the upper surface of the planar plate to position to the blade in a plane spaced above the plate; and a moveable arm engaging the elongate blade, movement of the arm causing the blade to move in a direction substantially transverse to the elongate slot.

2. The grate assembly of claim 1, wherein the planar plate includes a plurality of elongate slots.

3. The grate assembly of claim 2, wherein the plurality of elongate slots are substantially parallel.

4. The grate assembly of claim 3, wherein the elongate slots have a width that is less than the average diameter of the biomass pellets to be combusted in the stove.

5. The grate assembly of claim 3, wherein the elongate slots have a width of about 0.15 to 0.25 inches.

6. The grate assembly of claim 3, wherein the elongate slots represent an open area equivalent to about 50 to 70 percent of the surface area of the planar plate without the slots.

7. The grate assembly of claim 3, wherein the elongate blade is positioned in a plane spaced above the planar plate a distance greater than the diameter of the biomass pellets being combusted in the stove.

8. The grate assembly of claim 3, wherein the elongate blade is spaced about ¼ of an inch above the planar plate.

9. The grate assembly of claim 3, wherein the elongate blade includes fingers that extend substantially transverse from the blade away from the planar plate.

10. The grate assembly of claim 3, wherein the elongate blade is dimensioned to break up spent biomass pellets and direct ash into the elongate slots.

11. The grate assembly of claim 3, wherein the elongate blade has a cross section transverse to its length in the shape selected from the group consisting of a triangle, circle, or square.

12. The grate assembly of claim 1, wherein the first skid is located at the first end of the elongate blade and the second skid is located at the second end of the elongate blade.

13. The grate assembly of claim 1, wherein the first skid and the second skid are located between the first end and the second end of the elongate blade.

14. A grate assembly for use in a stove fueled by biomass pellets, the grate assembly comprising:

planar means for supporting the biomass pellets, the planar means including an upper surface and a lower surface opposite the upper surface, at least one slot having a longitudinal axis passing through the plate form the upper surface to the lower surface;

elongate means having a first end and a second end opposite the first end and extending substantially parallel to the slot;

first support means and a second support means attached to the elongate means and resting on the planar means to support the elongate means in a plane spaced above the planar means; and moveable means engaging the elongate means, movement of the moveable means causing the elongate means to move in a direction substantially transverse to the slot, movement of the elongate means breaking up spent biomass pellets and directing ash into the elongate slots.

15. The grate assembly of claim 14, wherein the planar means further comprises a plurality of slots.

16. The great assembly of claim 15, wherein the plurality of slots are substantially parallel.

17. The grate assembly of claim 16, wherein the slots have a width that is less than the average diameter of the biomass pellets to be combusted in the stove.

18. The grate assembly of claim 17, wherein the slots have a width of about 0.15 to 0.25 inches.

19. The grate assembly of claim 16, wherein the slots represent an open area equivalent to about 50 to 70 percent of the surface area of the planar means without the slots.

20. The grate assembly of claim 16, wherein the elongate means is positioned in a plane spaced above the planar means a distance greater than the diameter of the biomass pellets being combusted in the stove.

21. The grate assembly of claim 16, wherein the elongate means is spaced about ¼ of an inch above the planar means.

22. The grate assembly of claim 16, wherein the elongate means includes fingers that extend substantially transverse from the blade away from the planar plate.

23. The grate assembly of claim 16, wherein the elongate means is dimensioned to break up spent biomass pellets and direct ash accumulated on the planar means into the slots.

24. The grate assembly of claim 16, wherein the elongate means has a cross section transverse to its length in the shape selected from the group consisting of a triangle, circle, or square.

25. The grate assembly of claim 16, wherein the first support means and the second support means are located between the first end and the second end of the elongate means.

26. The grate assembly of claim 16, wherein the first support means is located at the first end and the elongate means and the second support means is located at the second end of the elongate means.

* * * * *

UNITED STATES PATENT AND TRADEMARK OFFICE

CERTIFICATE OF CORRECTION

PATENT NO. : 5,137,010

DATED : August 11, 1992

INVENTOR(S) : O.J. Whitfield, et al

It is certified that error appears in the above-indentified patent and that said Letters Patent is hereby corrected as shown below:

On the title page; Item [56] "402,002 10/1988 Rathbowe" should read —902,002 10/1908 Rathbone— and change "28332 11/1913 United Kingdom" to read —28,336 12/1913 United Kingdom—

| COLUMN | LINE | |
|---|---|---|
| 1 | 28 | after "clinkers" delete "and" |
| 1 | 63 | after "and" insert --a-- |
| 3 | 51 | "tubs" should read --tubes-- |
| 4 | 8 | "n" should read --in-- |
| 4 | 20 | "firewall" should read --firebox-- |
| 4 | 21 | "firewall" should read --firebox-- |
| 4 | 58 | "being" should read --begin-- |
| 5 | 47 | "fronts" should read --front-- |
| 7 | 14 | "lots" should read --slots-- |
| 7 | 34 | after "position" delete "to" |
| 8 | 15 | "form" should read --from-- |
| 8 | 65 | "and" should read --of-- |

Signed and Sealed this

Twelfth Day of October, 1993

Bruce Lehman

*Attest:*

BRUCE LEHMAN

*Attesting Officer*

*Commissioner of Patents and Trademarks*